US008507822B2

(12) United States Patent
Li

(10) Patent No.: US 8,507,822 B2
(45) Date of Patent: Aug. 13, 2013

(54) CONTACT MEMBER INCLUDING PURPOSELY INTRODUCED UNDULATIONS AND VACUUM INTERRUPTER INCLUDING THE SAME

(75) Inventor: Wangpei Li, Horseheads, NY (US)

(73) Assignee: Eaton Corporation, Cleveland, OH (US)

( * ) Notice: Subject to any disclaimer, the term of this patent is extended or adjusted under 35 U.S.C. 154(b) by 239 days.

(21) Appl. No.: 13/053,833

(22) Filed: Mar. 22, 2011

(65) Prior Publication Data

US 2012/0241413 A1 Sep. 27, 2012

(51) Int. Cl.
*H01H 33/02* (2006.01)

(52) U.S. Cl.
USPC ..... 218/121; 218/118; 218/136

(58) Field of Classification Search
USPC ..... 218/118, 136, 121
See application file for complete search history.

(56) References Cited

U.S. PATENT DOCUMENTS

| | | | | |
|---|---|---|---|---|
| 3,321,598 | A | 5/1967 | Streater | |
| 3,777,089 | A * | 12/1973 | Nitz | 218/136 |
| 3,778,573 | A * | 12/1973 | Harrold | 218/118 |
| 3,889,081 | A | 6/1975 | Hundstad | |
| 3,970,809 | A * | 7/1976 | Mitchell | 218/5 |
| 6,080,952 | A | 6/2000 | Okutomi et al. | |
| 7,250,584 | B2 | 7/2007 | Asmus et al. | |
| 2008/0302763 | A1 | 12/2008 | Stoving | |

FOREIGN PATENT DOCUMENTS

| | | | |
|---|---|---|---|
| DE | 26 33 543 | A1 | 2/1978 |
| DE | 35 33 890 | A1 | 4/1987 |
| GB | 839 083 | A | 6/1960 |
| JP | 60 039531 | U | 3/1985 |
| JP | 10-233145 | A | 9/1998 |
| JP | 2003 151412 | A | 5/2003 |

OTHER PUBLICATIONS

European Patent Office, "International search report and Written Opinion", Jul. 24, 2012, 14 pp.

* cited by examiner

*Primary Examiner* — Truc Nguyen
(74) *Attorney, Agent, or Firm* — Eckert Seamans Cherin & Mellott, LLC; Kirk D. Houser

(57) ABSTRACT

A contact is for a vacuum interrupter. The contact includes a contact member having a generally planar mating surface with a planar contact plane and a plurality of purposely introduced undulations therein. The undulations are structured to contact a plurality of purposely introduced undulations of another contact member. The undulations are in a dimension perpendicular to the planar contact plane. The planar contact plane has a diameter. The undulations have a depth substantially smaller than the diameter of the planar contact plane.

20 Claims, 7 Drawing Sheets

CONTACT MEMBER INCLUDING PURPOSELY INTRODUCED UNDULATIONS AND VACUUM INTERRUPTER INCLUDING THE SAME

BACKGROUND

1. Field

The disclosed concept pertains generally to contacts for vacuum interrupters and, more particularly, to contact members for a vacuum envelope. The disclosed concept further pertains to vacuum interrupters including fixed and movable contacts.

2. Background Information

Vacuum interrupters include separable main contacts disposed within an insulated and hermetically sealed vacuum chamber. The vacuum chamber typically includes a number of sections of ceramics (e.g., a number of tubular ceramic portions) for electrical insulation capped by a number of end members (e.g., without limitation, metal components, such as metal end plates; end caps; seal cups) to form an envelope in which a vacuum may be drawn. The ceramic section is typically cylindrical; however, other suitable cross-sectional shapes may be used. Two end members are typically employed. Where there are multiple ceramic sections, an internal center shield is disposed between the ceramic sections.

Vacuum circuit interrupters (e.g., without limitation, vacuum circuit breakers; vacuum switches; load break switches) provide protection for electrical systems from electrical fault conditions such as current overloads, short circuits, and low level voltage conditions. Typically, vacuum circuit interrupters include a spring-powered or other suitable operating mechanism, which opens electrical contacts inside a number of vacuum interrupters to interrupt the current flowing through the conductors in an electrical system in response to abnormal conditions.

The main contacts of vacuum interrupters are electrically connected to an external circuit to be protected by the vacuum circuit interrupter by electrode stems, typically an elongated member made from high purity copper. Generally, one of the contacts is fixed relative to the vacuum chamber as well as to the external circuit. The fixed contact is mounted in the vacuum envelope on a first electrode extending through one end member. The other contact is movable relative to the vacuum envelope. The movable contact is mounted on a movable electrode axially slidable through the other end member. The movable contact is driven by the operating mechanism and the motion of the operating mechanism is transferred inside the vacuum envelope by a coupling that includes a sealed metallic bellows. The fixed and movable contacts form a pair of separable contacts which are opened and closed by movement of the movable electrode in response to the operating mechanism located outside of the vacuum envelope. The electrodes, end members, bellows, ceramic shell(s), and the internal shield, if any, are joined together to form the vacuum interrupter (VI) capable of maintaining a vacuum at a suitable level for an extended period of time.

With the wide acceptance of vacuum interruption technology in medium voltage switchgear, vacuum interrupters are being used in more and more demanding applications. One example is the ever increasing continuous current requirement. However, a high continuous current carrying capability is not easy to achieve, especially in an axial magnetic field (AMF) type VI, where the current is often forced into a relatively long circular path to generate the necessary axial magnetic field. A longer circular VI current path provides a stronger axial magnetic field and, hence, a better current interruption capability, although this increases the total resistance of the VI. For this reason, it is desirable to find ways to reduce the resistance of a VI without compromising its current interruption capability.

In known modern commercial vacuum interrupters, the mating surface on the arcing face of the movable contact and the fixed contact is two-dimensional (i.e., planar). See, for example, FIGS. 1 and 2. In these designs with a planar mating surface 2,4, the physical contact between the two opposing electrical contacts 6,8 and 10,12 often ends up taking place only at a limited number of discrete locations of the planar surfaces (e.g., a worst case scenario is three discrete locations), due to inevitable surface imperfections resulting from machining a fresh contact surface or roughening an existing contact surface from arc melting. As a result, the electrical resistance of the resulting joint, between the electrical contacts, can be significant.

In some older vacuum interrupters, it is known to provide movable and fixed contacts that mate in three dimensions, macroscopically (i.e., on at least two different surfaces of the contacts normal to the planar mating area, where the magnitude of the different surfaces are similar to the magnitude of the planar mating area). Examples are shown by U.S. Pat. Nos. 3,321,598 and 3,889,081.

There is room for improvement in vacuum interrupters.

There is further room for improvement in fixed and movable contacts of a vacuum interrupter.

SUMMARY

These needs and others are met by embodiments of the disclosed concept, which provides a contact member comprising a generally planar mating surface having a planar contact plane and a plurality of purposely introduced undulations therein. The undulations are structured to contact a plurality of purposely introduced undulations of another contact member, are in a dimension perpendicular to the planar contact plane, and have a depth substantially smaller than the diameter of the planar contact plane.

In accordance with one aspect of the disclosed concept, a contact for a vacuum interrupter comprises: a contact member comprising a generally planar mating surface having a planar contact plane and a plurality of purposely introduced undulations therein, the undulations being structured to contact a plurality of purposely introduced undulations of another contact member, wherein the undulations are in a dimension perpendicular to the planar contact plane, wherein the planar contact plane has a diameter; and wherein the undulations have a depth substantially smaller than the diameter of the planar contact plane.

As another aspect of the disclosed concept, a vacuum interrupter comprises: a vacuum envelope; a fixed contact member comprising a first generally planar mating surface having a planar contact plane and a plurality of purposely introduced first undulations therein; and a movable contact member comprising a second generally planar mating surface having a planar contact plane and a plurality of purposely introduced second undulations therein, wherein the first undulations are in a dimension perpendicular to the planar contact plane of the first generally planar mating surface, wherein the second undulations are in a dimension perpendicular to the planar contact plane of the second generally planar mating surface, wherein the planar contact plane of the first generally planar mating surface has a first diameter, wherein the planar contact plane of the second generally planar mating surface has a second diameter, wherein the first undulations have a depth substantially smaller than the first diameter, wherein the second undulations have a depth substantially smaller than the second diameter, and wherein the first undulations contact the second undulations in a closed contact position.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "undulation" or "undulations" shall mean: (1) having a three-dimensional structure with a wavy appearance, outline, or form; (2) having a three-dimensional structure exhibiting waviness; or (3) having a three-dimensional structure in the form of a number of concentric ripples, a number of arrays of concave areas and convex areas, or a number of geometric shapes. Non-limiting examples of undulations include those having a two-dimensional profile in the form of a number of concave and convex portions, a plurality of partially circular arcs, a trigonometric wave, a saw-tooth shape, a number of square shapes, a number of rectangular shapes, a plurality of different geometric shapes, a repetitive pattern that is repeated a plurality of times (e.g., without limitation, two; three; four; any suitable count), or any combination of the foregoing, as long as, for example, the concave portions of one contact correspond with and contact the convex portions of the opposite contact in a closed position of a vacuum interrupter.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

Figure 1:
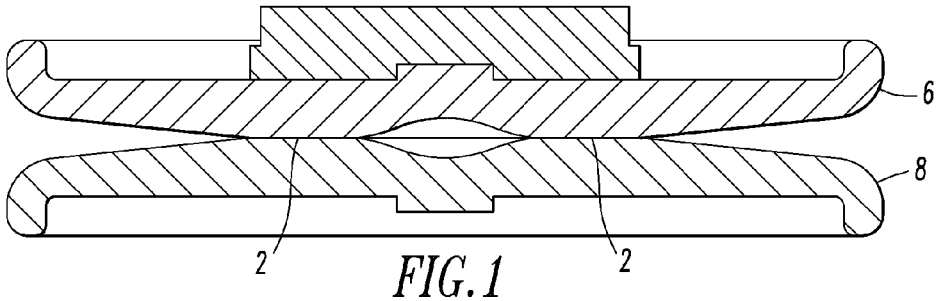
FIG. 1 PRIOR ART
FIGS. 1 and 2 are vertical sectional views of movable and fixed contacts in a closed position of a vacuum interrupter.
Figure 2:
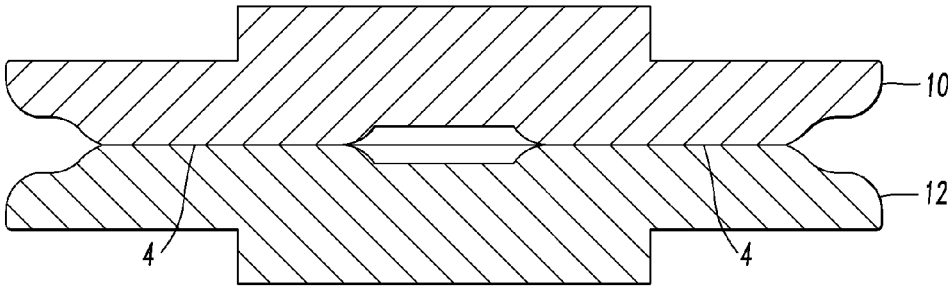
FIG. 2 PRIOR ART
Figure 3A:
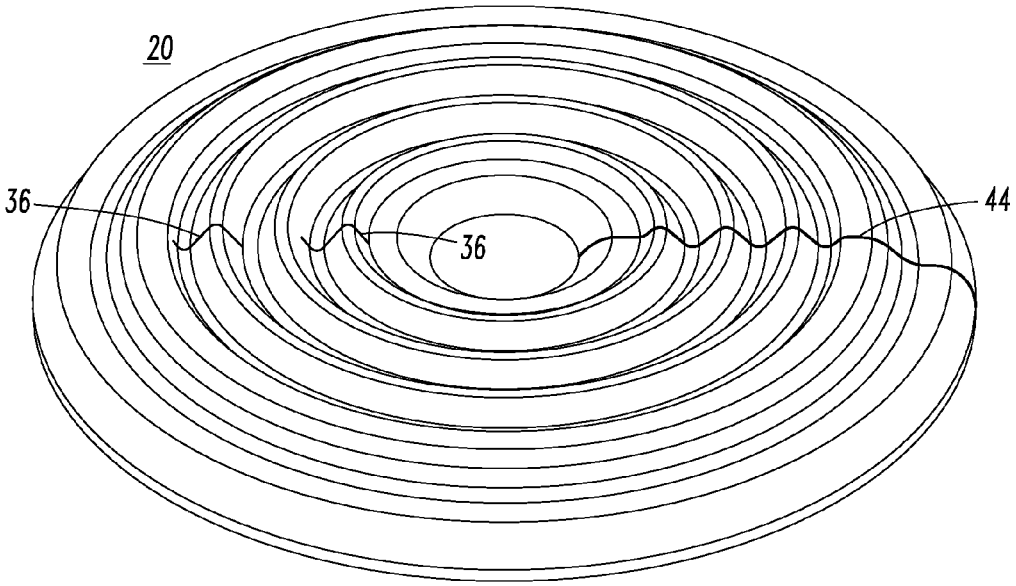
FIG. 3A is an isometric view of a fixed contact in accordance with an embodiment of the disclosed concept.
Figure 3B:
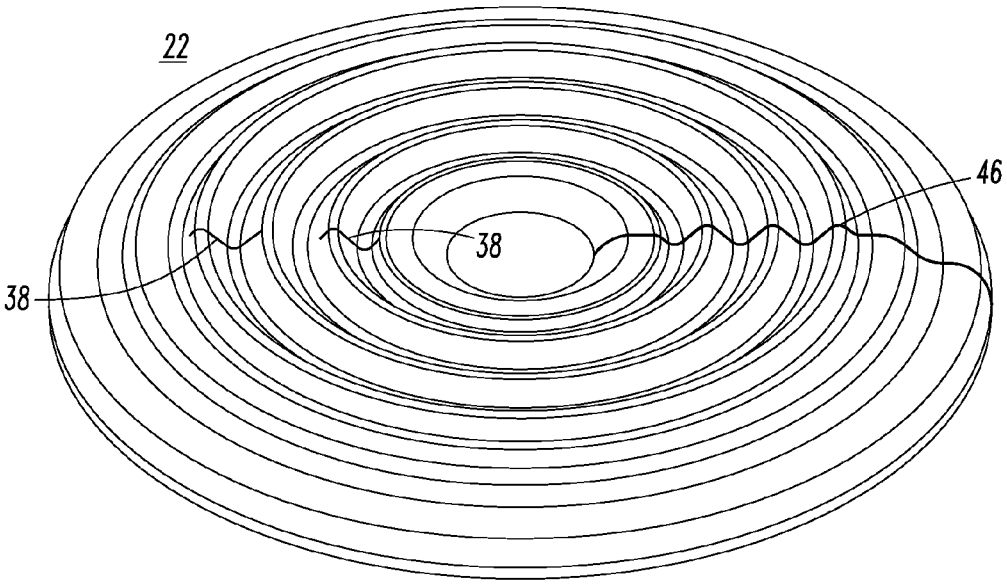
FIG. 3B is an isometric view of a movable contact in accordance with an embodiment of the disclosed concept.
Figure 3C:
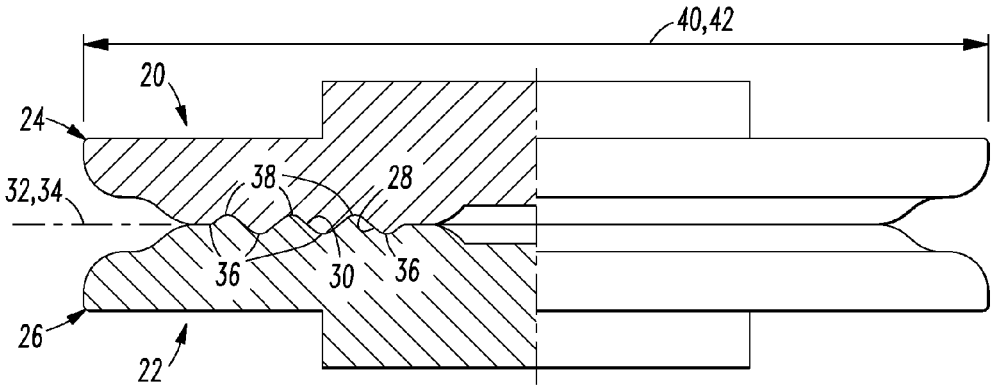
FIG. 3C is a partial vertical sectional view of the fixed and movable contacts of FIGS. 3A and 3B, respectively, in a closed position of a vacuum interrupter.

Referring to FIGS. 3A-3C, a contact 20 or 22 for a vacuum interrupter (not shown, but see vacuum interrupter 110 of FIG. 7) includes a contact member 24 or 26 having a generally planar mating surface 28 or 30 with a planar contact plane 32 or 34 and a plurality of purposely introduced undulations 36 (shown for convenience of illustration as a two-dimensional profile in FIG. 3A) or 38 (shown for convenience of illustration as a two-dimensional profile in FIG. 3B), respectively, therein. The undulations 36,38 are structured to contact a plurality of purposely introduced undulations 38,36 of the other contact member 26,24, respectively. The undulations 36,38 are in a dimension perpendicular to the planar contact plane 32,34, respectively. The planar contact plane 32,34 has a respective diameter 40,42. The undulations 36,38 have a depth (e.g., without limitation, in the range of about 0.01 inch to about 0.3 inch) substantially smaller than the planar contact plane diameter 40,42, respectively.

The example contact member 24 is a fixed contact, and the example contact member 26 is a movable contact, although contact member 24 can be a movable contact and contact member 26 can be a fixed contact. Although example undulations 36,38 are shown, any suitable undulations having a three-dimensional structure selected from the group consisting of a number of concentric ripples, a number of arrays of concave areas and convex areas, and a number of geometric shapes can be employed.

Figure 4C:
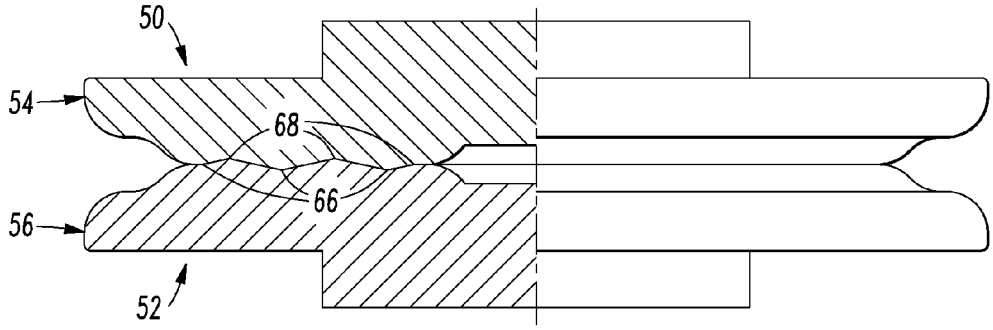
FIG. 4C is a partial vertical sectional view of the fixed and movable contacts of FIGS. 4A and 4B, respectively, in a closed position of a vacuum interrupter.
Figure 4A:
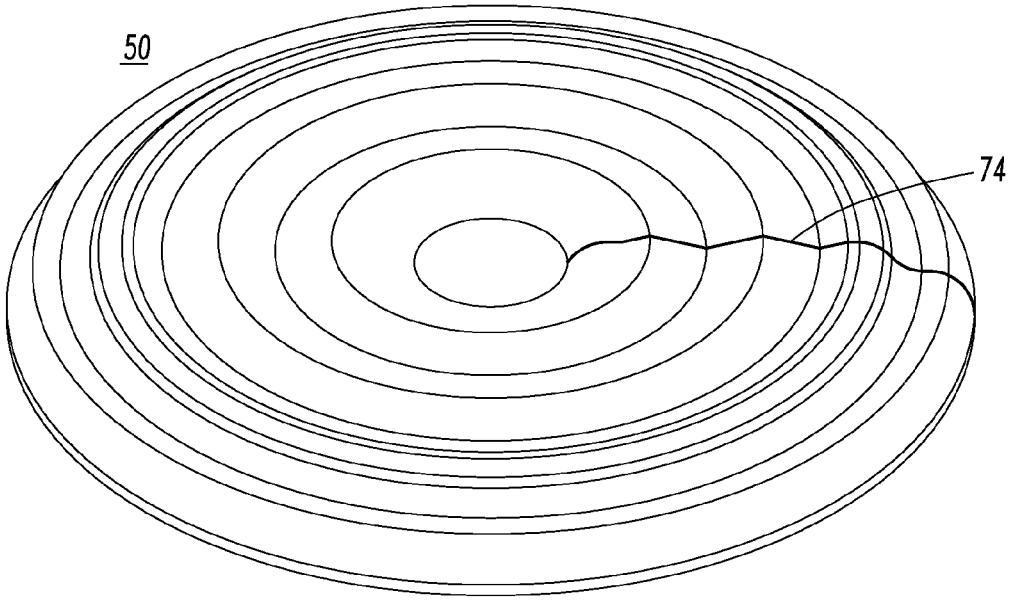
FIG. 4A is an isometric view of a fixed contact in accordance with an embodiment of the disclosed concept.
Figure 4B:
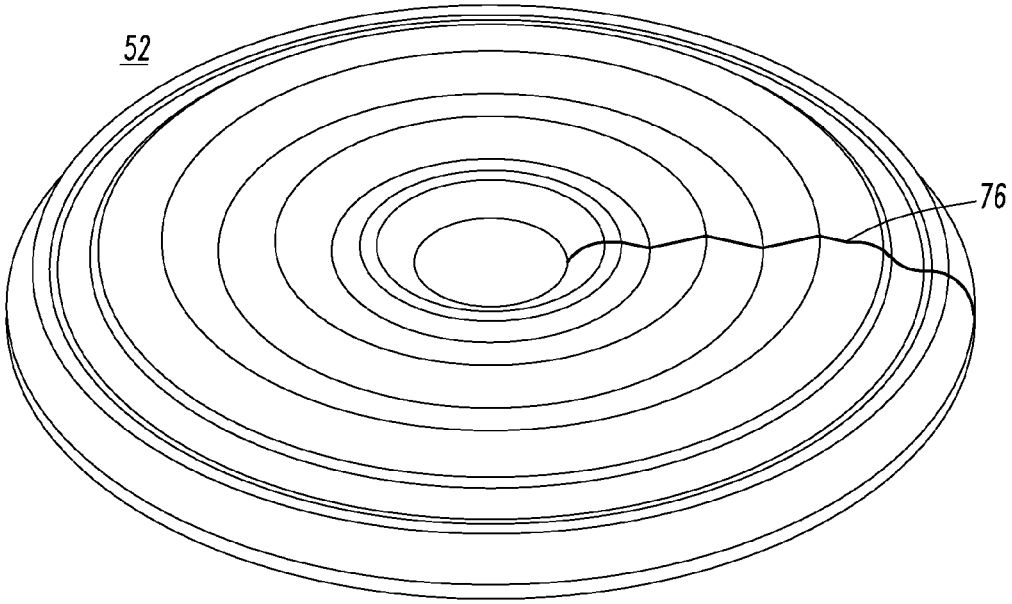
FIG. 4B is an isometric view of a movable contact in accordance with an embodiment of the disclosed concept.

FIGS. 3A-3C show an embodiment where the example undulations 36,38 are concentric ripples (as best shown in FIGS. 3A and 3B) that can be easily machined with a lathe. FIG. 3C shows the two contacts 20,22 when mated in a vacuum interrupter (not shown, but see FIG. 7) in the "closed" position. The example mating surfaces are undulated with contiguous ripples of a trigonometric wave, such as the example sine-wave cross-sectional profile 44,46. The convex (concave) portions in the surface of the fixed contact 24 correspond with and contact the concave (convex) portions in the surface of the movable contact 26. Alternatively, the undulations 36,38 can have a two-dimensional profile in the form of a plurality of partially circular arcs, a plurality of square or rectangular shapes, or a plurality of V-shaped convex portions and a plurality of V-shaped concave portions (FIGS. 4A-4C). In the examples of FIGS. 3A and 3B, the first undulations 36 have a shape that complements a shape of the second undulations 38, in order that the first generally planar mating surface 28 corresponds with and contacts the second generally planar mating surface 30 in the closed position of FIG. 3C.

In accordance with the disclosed concept, the mating surfaces of fixed and movable contacts, such as 24,26, are almost, but not completely, planar, and include purposely introduced undulations, such as 36,38, which are relatively small in scale (e.g., without limitation, about 0.01 inch to about 0.3 inch; any suitable distance) in the dimension perpendicular to the major planar contact plane, such as 32,34. Such undulations can have a wavy appearance, outline, or form; can exhibit a waviness; or can have a two-dimensional profile in the form of a number of concave and convex portions, a number of partially circular arcs, a trigonometric wave, a saw-tooth shape, a number of square shapes, a number of rectangular shapes, or any combination of the foregoing, as long as, for example, the concave portions of one contact correspond with and contact the convex portions of the opposite contact of a vacuum interrupter in the closed position thereof.

As a non-limiting example, the planar contact planes 32,34 can have a diameter ranging from about 0.5 inch to about 5.5 inches. A height or a depth of the example undulations, such as 36,38, above or below the respective generally planar mating surfaces 28,30 ranges from about 0.01 inch to about 0.3 inch. A distance between a peak and a valley of the undulations, such as 36,38, on the respective generally planar mating surfaces 28,30 ranges from about 0.05 inch to about 2.5 inches.

The peak-valley distance or width may be in the same order of magnitude as half of the diameter of the planar contact plane of the contact. Similarly, with reference to FIG. 6A, the diameter of the relatively large concave areas 99 and the relatively large convex areas 100 can be about ⅙ of the diameter of the mating surface, although it is possible for these areas 99,100 to be as wide as half of the diameter of the mating surface while being relatively shallow in depth.

FIGS. 4A-4C show another embodiment where undulations 66,68 have two-dimensional profiles 74,76 in the form of V-shaped convex portions and V-shaped concave portions or a saw-tooth shape. FIG. 4A shows a contact 50 including a contact member 54 (e.g., a fixed contact; a movable contact of FIG. 4C), FIG. 4B shows a contact 52 including a contact member 56 (e.g., a movable contact; a fixed contact of FIG. 4C), and FIG. 4C shows the two contacts 50,52 when mated in a vacuum interrupter (not shown, but see FIG. 7) in the "closed" position. The convex (concave) portions in the surface of the contact member 54 correspond with and contact the concave (convex) portions in the surface of the other contact member 56 in the closed position. Although example V-shaped convex portions and V-shaped concave portions are shown, it will be appreciated that the cooperating corresponding convex and concave portions can employ any number of the same or different types of shapes.

Figure 5C:
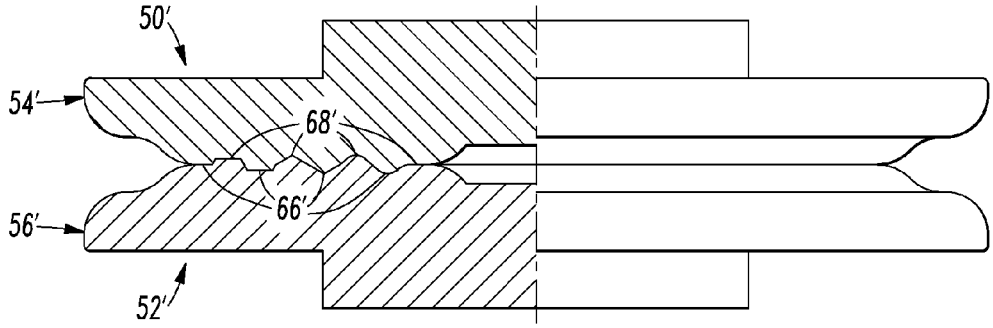
FIG. 5C is a partial vertical sectional view of the fixed and movable contacts of FIGS. 5A and 5B, respectively, in a closed position of a vacuum interrupter.
Figure 5A:
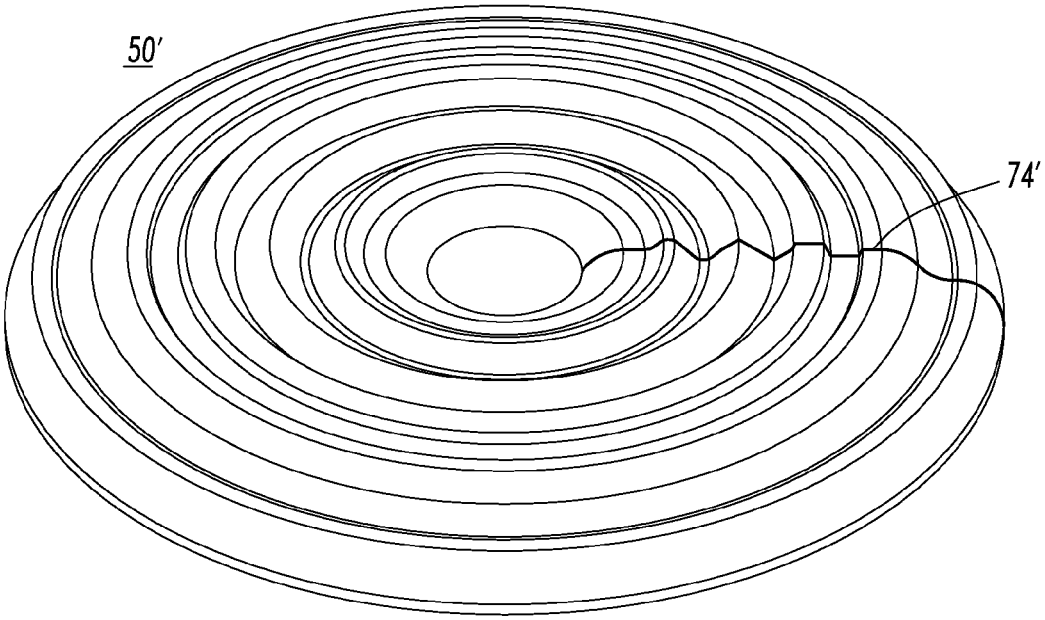
FIG. 5A is an isometric view of a fixed contact in accordance with an embodiment of the disclosed concept.
Figure 5B:
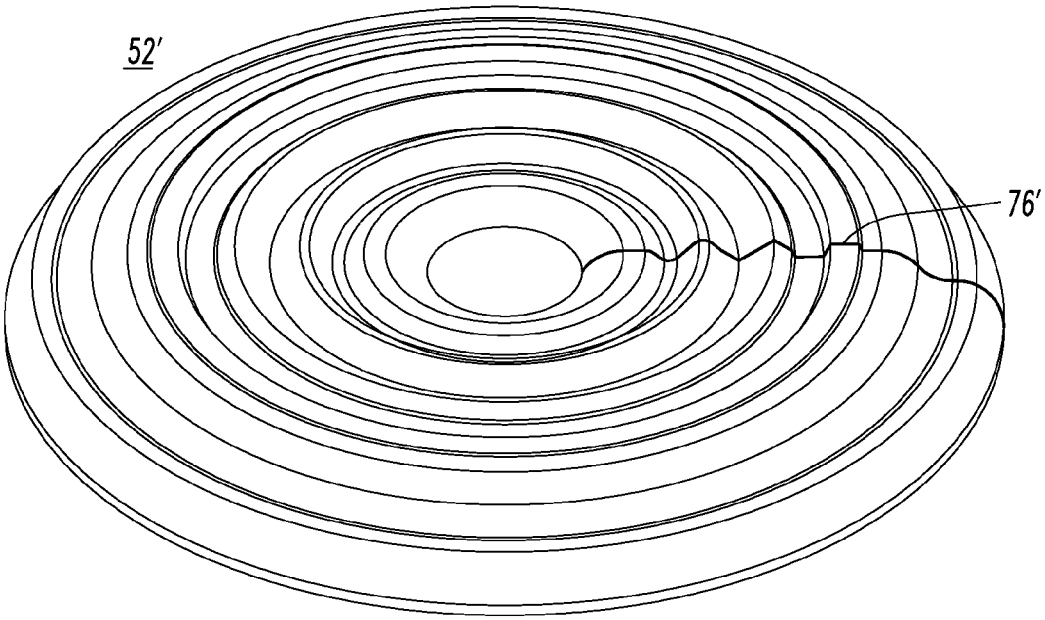
FIG. 5B is an isometric view of a movable contact in accordance with an embodiment of the disclosed concept.

FIGS. 5A-5C show another embodiment where undulations 66',68' have two-dimensional profiles 74',76' in the form of a plurality of different geometric shapes. FIG. 5A shows a contact 50' including a contact member 54' (e.g., a fixed contact; a movable contact of FIG. 5C), FIG. 5B shows a contact 52' including a contact member 56' (e.g., a movable contact; a fixed contact of FIG. 5C), and FIG. 5C shows the two contacts 50',52' when mated in a vacuum interrupter (not shown, but see FIG. 7) in the "closed" position. The convex (concave) portions in the surface of the contact member 54' correspond with and contact the concave (convex) portions in the surface of the other contact member 56' in the closed position. Although example two-dimensional profiles 74',76' are shown, it will be appreciated that the cooperating corresponding convex and concave portions can employ any number of the same or different types of shapes, contiguous or non-contiguous ripples, a trigonometric curve, a saw-tooth, a trapezoid and/or a repetitive pattern that is repeated a plurality of times (e.g., without limitation, two; three; four; any suitable count).

Figure 6A:
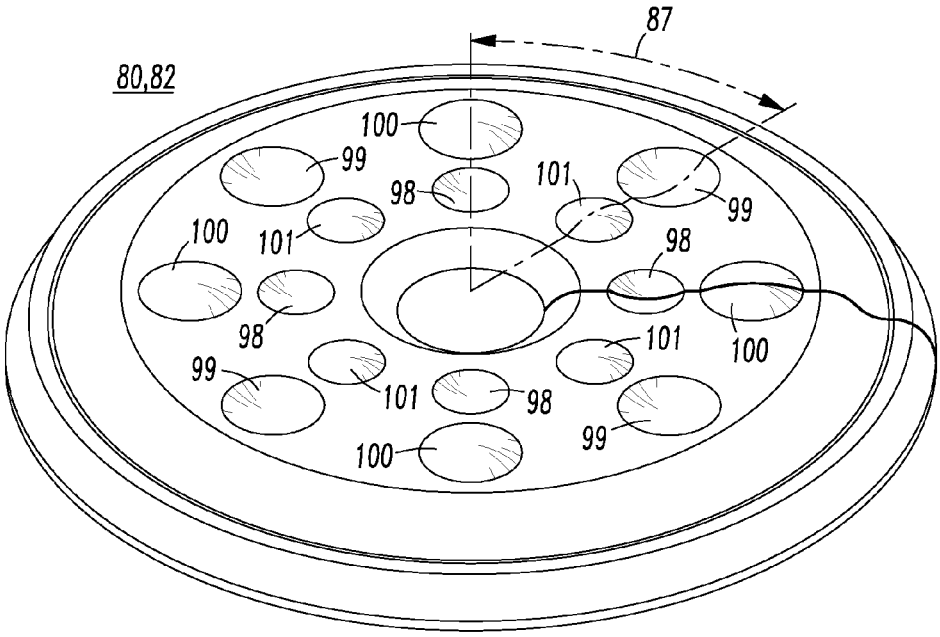
FIG. 6A is an isometric view of a fixed or movable contact in accordance with an embodiment of the disclosed concept.
Figure 6B:
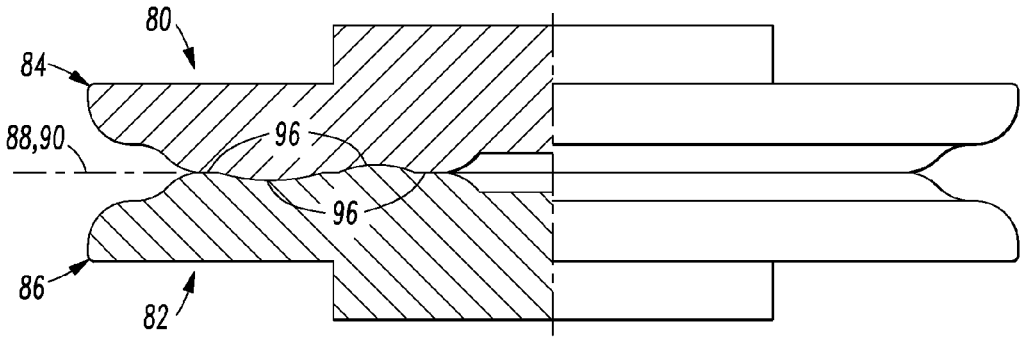
FIG. 6B is a partial vertical sectional view of the fixed and movable contacts of FIG. 6A, in a closed position of a vacuum interrupter.

FIGS. 6A and 6B show another embodiment where example undulations 96 have a three-dimensional structure that is a number of arrays of concave areas 98,99 (e.g., without limitation, dimples) and convex areas 100,101 (e.g., without limitation, bumps). FIGS. 6A and 6B show a contact 80 or 82 including a contact member 84 or 86 (e.g., a fixed contact or a movable contact), and FIG. 6B shows the two contacts 80,82 when mated in a vacuum interrupter (not shown, but see FIG. 7) in the "closed" position. The convex (concave) portions in the surface of the contact member 84 correspond with and contact the concave (convex) portions in the surface of the other contact member 86 in the closed position. Both of the movable contact and the fixed contact have the same shape, but are assembled with a different azimuthal angle 87 (e.g., without limitation, 45° in the example of FIGS. 6A and 6B) offset to each other, in order that the dimples (bumps) in one contact 80 correspond with and contact the bumps (dimples) in the other contact 82 in the closed position. Although an example three-dimensional structure is shown, it will be appreciated that the cooperating corresponding convex and concave portions can employ any suitable structure that can mate with the same structure which is assembled with a suitable different azimuthal angle offset therefrom, in order that the generally planar mating surface 88 corresponds with and contacts the other generally planar mating surface 90 in the closed position.

Figure 7:
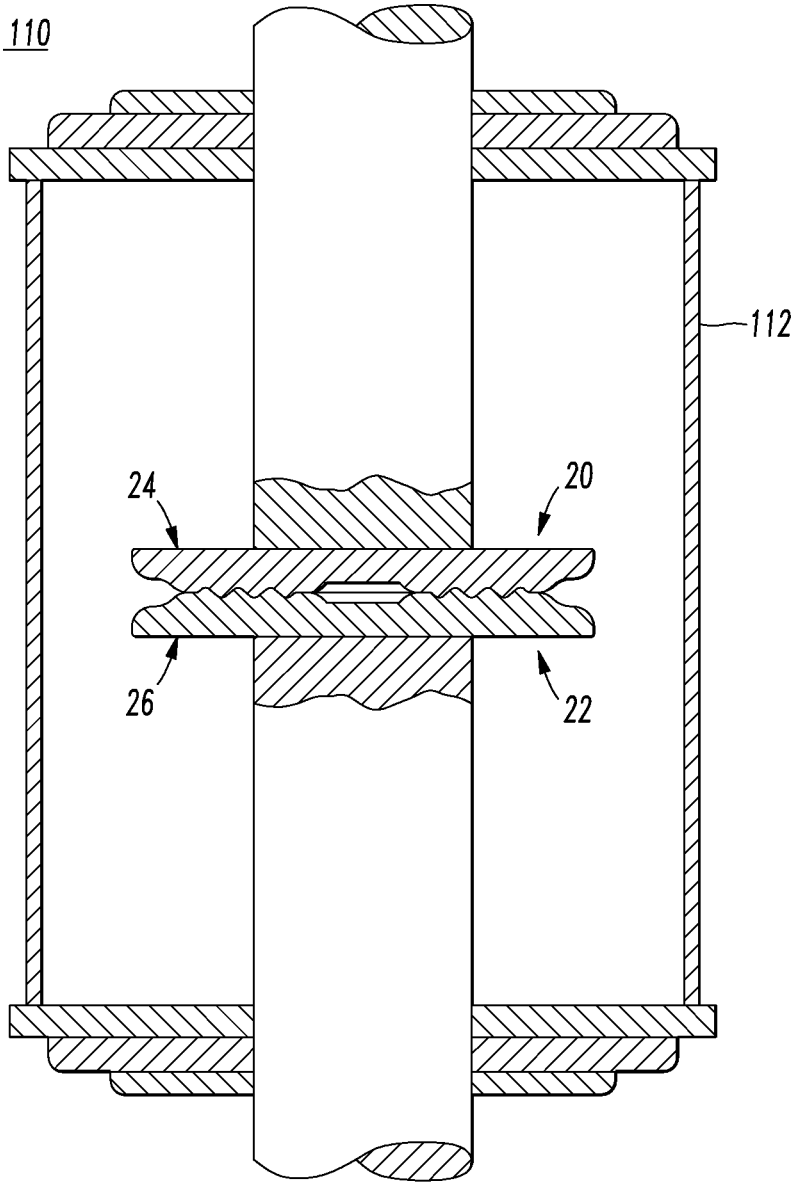
FIG. 7 is a vertical elevation sectional view of a vacuum interrupter including fixed and movable contacts in accordance with an embodiment of the disclosed concept.

FIG. 7 shows a vacuum interrupter 110 including a vacuum envelope 112, the fixed contact member 24 of FIG. 3A, and the movable contact member 26 of FIG. 3B. The first undulations 36 (best shown in FIG. 3A) contact the second undulations 38 (best shown in FIG. 3B) in the closed contact position, as shown in FIGS. 3C and 7.

The disclosed concept and the disclosed slightly non-planar mating surface between the two contacts 20,22 of the vacuum interrupter 110 provide the advantages of: (1) increased effective contact area (as opposed to conventional contacts employing flat planar surfaces), which helps to reduce the resistance of the electrical joint between the movable contact member 26 and the fixed contact member 24; and (2) increased hindrance to the splashing of a molten liquid layer while the contacts 20,22 are subjected to arcing. The first advantage certainly helps the continuous current carrying capability, while the second advantage may help the dielectric recovery of the contact gap and, hence, the high current interruption performance of the disclosed vacuum interrupter 110.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A contact for a vacuum interrupter, said contact comprising:

a contact member comprising a generally planar mating surface having a planar contact plane and a plurality of purposely introduced undulations therein, said undulations being structured to contact a plurality of purposely introduced undulations of another contact member, wherein the undulations are in a dimension perpendicular to the planar contact plane, wherein the undulations have a two-dimensional profile in the form of a plurality of concave portions and a plurality of convex portions, wherein the concave and convex portions of said contact member contact the convex and concave portions, respectively, of said another contact member in a closed contact position, wherein the planar contact plane has a diameter, and wherein the undulations have a depth substantially smaller than the diameter of the planar contact plane.

2. The contact of claim 1 wherein said contact member is a fixed contact.

3. The contact of claim 1 wherein said contact member is a movable contact.

4. The contact of claim 1 wherein the undulations further have a three-dimensional structure selected from the group consisting of a number of concentric ripples, a number of arrays of concave areas and convex areas, and a number of geometric shapes.

5. The contact of claim 1 wherein the undulations have the two-dimensional profile in the form of a plurality of partially circular arcs.

6. The contact of claim 1 wherein the undulations have the two-dimensional profile in the form of a trigonometric wave.

7. The contact of claim 1 wherein the undulations have the two-dimensional profile in the form of a saw-tooth shape.

8. The contact of claim 1 wherein the undulations have the two-dimensional profile in the form of a number of square shapes or a number of rectangular shapes.

9. The contact of claim 1 wherein the undulations have the two-dimensional profile in the form of a plurality of different geometric shapes.

10. The contact of claim 1 wherein the undulations have the two-dimensional profile in the form of a repetitive pattern that is repeated a plurality of times.

11. A vacuum interrupter comprising:

a vacuum envelope;

a fixed contact member comprising a first generally planar mating surface having a planar contact plane and a plurality of purposely introduced first undulations therein; and a movable contact member comprising a second generally planar mating surface having a planar contact plane and a plurality of purposely introduced second undulations therein, wherein the first undulations are in a dimension perpendicular to the planar contact plane of the first generally planar mating surface, wherein the second undulations are in a dimension perpendicular to the planar contact plane of the second generally planar mating surface, wherein the planar contact plane of the first generally planar mating surface has a first diameter, wherein the planar contact plane of the second generally planar mating surface has a second diameter, wherein the first undulations have a depth substantially smaller than the first diameter, wherein the second undulations have a depth substantially smaller than the second diameter, wherein the first undulations contact the second undulations in a closed contact position, wherein the first and second undulations have a two-dimensional profile in the form of a plurality of concave portions and a plurality of convex portions, and wherein the concave portions of one of said movable contact member and said fixed contact member contact the convex portions of the other one of said movable contact member and said fixed contact member in the closed contact position.

12. The vacuum interrupter of claim 11 wherein the first and second undulations further have a three-dimensional structure selected from the group consisting of a number of concentric ripples, a number of arrays of concave areas and convex areas, and a number of geometric shapes.

13. A vacuum interrupter comprising:

a vacuum envelope;

a fixed contact member comprising a first generally planar mating surface having a planar contact plane and a plurality of purposely introduced first undulations therein; and a movable contact member comprising a second generally planar mating surface having a planar contact plane and a plurality of purposely introduced second undulations therein, wherein the first undulations are in a dimension perpendicular to the planar contact plane of the first generally planar mating surface, wherein the second undulations are in a dimension perpendicular to the planar contact plane of the second generally planar mating surface, wherein the planar contact plane of the first generally planar mating surface has a first diameter, wherein the planar contact plane of the second generally planar mating surface has a second diameter, wherein the first undulations have a depth substantially smaller than the first diameter, wherein the second undulations have a depth substantially smaller than the second diameter, wherein the first undulations contact the second undulations in a closed contact position, wherein the first and second undulations have a number of arrays of concave areas and convex areas, and wherein the number of arrays of concave areas and convex areas comprise a plurality of concave dimples and a plurality of convex bumps, each of said concave dimples contacting a corresponding one of said convex bumps in the closed contact position.

14. The vacuum interrupter of claim 11 wherein the first and second undulations have the two-dimensional profile in the form of a plurality of partially circular arcs.

15. The vacuum interrupter of claim 11 wherein the first and second undulations have the two-dimensional profile in the form of a trigonometric wave.

16. The vacuum interrupter of claim 11 wherein the first and second undulations have the two-dimensional profile in the form of a saw-tooth shape.

17. The vacuum interrupter of claim 11 wherein the first and second undulations have the two-dimensional profile selected from the group consisting of a plurality of square shapes, a plurality of rectangular shapes, and a plurality of V-shaped convex portions and a plurality of V-shaped concave portions.

18. The vacuum interrupter of claim 11 wherein the planar contact plane of the first and second generally planar mating surfaces has a diameter ranging from about 0.5 inch to about 5.5 inches; wherein a height or a depth of the first and second undulations above or below, respectively, the first and second generally planar mating surfaces ranges from about 0.01 inch to about 0.3 inch; and wherein a distance between a peak and a valley of the first and second undulations on the first and second generally planar mating surfaces ranges from about 0.05 inch to about 2.5 inches.

19. The vacuum interrupter of claim 11 wherein the first generally planar mating surface of said fixed contact member is the same as the second generally planar mating surface of said movable contact member; wherein said fixed contact member has a first azimuthal angle; and wherein said movable contact member has a different second azimuthal angle, in order that the first generally planar mating surface corresponds with and contacts the second generally planar mating surface in the closed contact position.

20. The vacuum interrupter of claim 11 wherein the first undulations have a shape that complements a shape of the second undulations, in order that the first generally planar mating surface corresponds with and contacts the second generally planar mating surfaced in the closed contact position.

* * * * *